US007604056B2

(12) United States Patent
Haynes

(10) Patent No.: US 7,604,056 B2
(45) Date of Patent: Oct. 20, 2009

(54) DOWNHOLE VALVE AND METHOD OF MAKING

(75) Inventor: Andrew Haynes, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 208 days.

(21) Appl. No.: 11/682,978

(22) Filed: Mar. 7, 2007

(65) Prior Publication Data

US 2008/0217020 A1 Sep. 11, 2008

(51) Int. Cl.
*E21B 34/10* (2006.01)

(52) U.S. Cl. ..... 166/332.8; 166/332.1; 166/316

(58) Field of Classification Search ..... 166/332.8, 166/316, 332.1
See application file for complete search history.

(56) References Cited

U.S. PATENT DOCUMENTS 4,531,587 A 7/1985 Fineberg
6,810,955 B2 11/2004 Roth et al.
6,896,049 B2 5/2005 Moyes
2004/0065442 A1 * 4/2004 Myerley et al. ..... 166/373

OTHER PUBLICATIONS

Zertech Z-Seal, [online]; [retrieved on Oct. 23, 2006]; retrieved from the Internet http://www.zertech.com/zseal.htm.

* cited by examiner

*Primary Examiner*—Jennifer H Gay
*Assistant Examiner*—Brad Harcourt
(74) *Attorney, Agent, or Firm*—Cantor Colburn LLP

(57) ABSTRACT

Disclosed herein is a downhole valve. The downhole valve includes, a flapper seat, a flapper sealable against the flapper seat, a spring housing in axial alignment with the flapper seat and a metal-to-metal seal disposed between the flapper seat and the spring housing. The metal-to-metal seal is sealable to both the flapper seat and the spring housing when in an energized position. Additionally, the metal-to-metal seal is a separate component from both the flapper seat and the spring housing.

20 Claims, 3 Drawing Sheets

DOWNHOLE VALVE AND METHOD OF MAKING

BACKGROUND OF THE INVENTION

In the downhole industry, valves are a common part of a system. Valves come in a variety of configurations; all intended to control the flow of fluid in one direction or another. One such configuration is known in the vernacular as a flapper valve. Such valves generally open to fluid flow in one direction (for example downhole direction) while closing to flow in an opposite direction (for example an uphole direction). Most commonly flapper valves are a part of a commercial product known as a safety valve, which allows an operator to maintain a flow passage only while an external input is maintained on the valve. For example, the valve may be a hydraulically operated valve that stays open as long as hydraulic pressure is supplied thereto through a hydraulic control line. The flapper will automatically close in the event that the hydraulic pressure is released. Such valves are very effective for their intended purposes.

Construction of safety valves is undertaken by utilizing a number of individual components and fastening them to one another to build the final product. In order to produce a commercially acceptable product, special threads with tight tolerances have been used to provide for sealing at one or more of the connection sites to prevent fluid migration therethrough. One such connection site is the interface between a flapper seat and a spring housing. Because special threads are expensive and require extra care during manufacture, a lower cost alternative at such interfaces would be welcomed by the art.

BRIEF DESCRIPTION OF THE INVENTION

Disclosed herein is a downhole valve. The downhole valve includes, a flapper seat, a flapper sealable against the flapper seat, a spring housing in axial alignment with the flapper seat and a metal-to-metal seal disposed between the flapper seat and the spring housing. The metal-to-metal seal is sealable to both the flapper seat and the spring housing when in an energized position. Additionally, the metal-to-metal seal is a separate component from both the flapper seat and the spring housing.

Further disclosed herein is a method of making a valve. The method includes positioning a non-energized tubular member radially between a flapper seat and a spring housing. Wherein the tubular member has at least one line of weakness on an outside surface and at least one line of weakness on an inside surface. The method further including energizing the tubular member with the flapper seat and the spring housing. The energizing being accomplished by deforming a first portion of the tubular member radially outwardly, to sealably engage one of the flapper seat and the spring housing, and by deforming a second portion of the tubular member radially inwardly, to sealably engage the other of the flapper seat and the spring housing that is not sealably engaged with the first portion.

Still further disclosed herein is a method of sealing valve components. The method including energizing a tubular metal-to-metal seal between a flapper seat and a spring housing to thereby sealingly engage the metal-to-metal seal with the flapper seat and the spring housing. The energizing further includes radially compressing the metal-to-metal seal in an annular opening between the spring housing and the flapper seat.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of an embodiment of the disclosed apparatus and method are presented herein by way of exemplification and not limitation with reference to the Figures.

Figure 1:
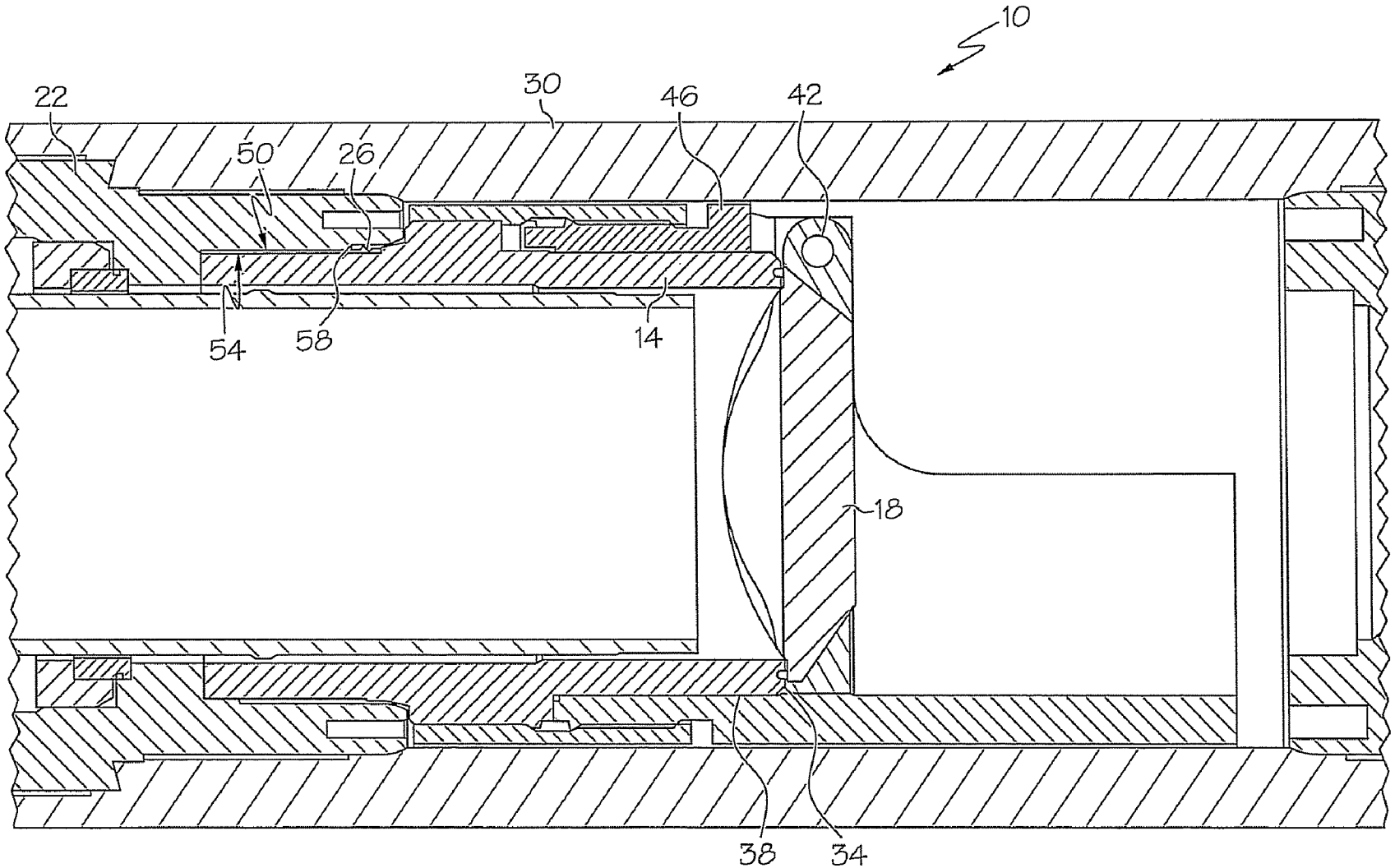
FIG. 1 depicts a partial cross sectional view of a downhole valve disclosed herein.

Referring to FIG. 1, an embodiment of the downhole valve 10 is illustrated. The valve 10 is configured such that when it is open the valve 10 allows fluid to flow in either an uphole or a downhole direction. When the valve 10 is closed, however, it prevents fluid flow in an uphole direction. The valve 10 includes a flapper seat 14, a flapper 18, a spring housing 22 and a metal-to-metal seal 26, all of which are located in this embodiment within a flapper housing 30. Each of these components will be recognized by one of ordinary skill in the art as parts of a commercially available flapper or safety valve. In this embodiment the flapper seat 14 is a metallic tubular member with a sealing surface 34 on an axial end 38 thereof. The flapper 18 may also be made of metal and is sealable to the sealing surface 34. The flapper 18 is rotatable between a sealed position (as shown) and an open position by rotation about a hinge 42. The hinge 42 may be integrally formed as part of the flapper seat 14 or may be attached to a separate hinge mount 46, as shown. Fluid pressure in a hydraulic control line (not shown) urges the flapper 18 in an open direction. Fluid pressure downhole of the valve 10 urges the flapper 18 to a closed position when the pressure in the hydraulic control line is reduced.

The valve 10 being in a closed position prevents flow of fluid in an uphole direction. With the valve in this position a substantial amount of pressure can, under some circumstances, build uphole of the valve 10. While higher pressure downhole of the valve 10 will cause the flapper 18 to more tightly engage the seat 14 thereby creating a tighter seal, that pressure is also transmitted to the threaded connection between the flapper seat 14 and the spring housing 22. And while a threaded arrangement with a seal nose metal-to-metal interference is capable of holding pressure it requires a much more expensive manufacturing process due to much tighter tolerances that are required to be held in addition to requiring a greater cross sectional area thereby creating more cost. In order to alleviate the problem, a metal-to-metal seal element 26 is taught herein. The seal element 26 is located between the flapper seat 14 and the spring housing 22, more specifically, in this embodiment, between an outside surface 50 of the flapper seat and an inside surface 54 of the spring housing 22. It should be noted that in alternate embodiments this condition could be reversed, that is, the flapper seat 14 could be configured with an inside surface and the spring housing 22 could be configured with an outside surface. As one of skill in the art may recognize, this is the same location at which a threaded sealing arrangement would normally occur but with the invention, manufacturing tolerances are relaxed substantially. To accommodate the seal 26 and to simplify construction of the valve, in one embodiment, and as illustrated, a recess 58 on the inside surface 54 of the spring housing 22 is provided that includes an inside sealing surface 56 thereat. The recess 58 is sized to receive part of the seal 26 such that the seal is retained therein when the flapper seat and the spring housing are not yet joined. In alternate embodiments, the recess 58 could be in the outer surface 50 of the flapper seat 14 and achieve the same effect.

Figure 2:
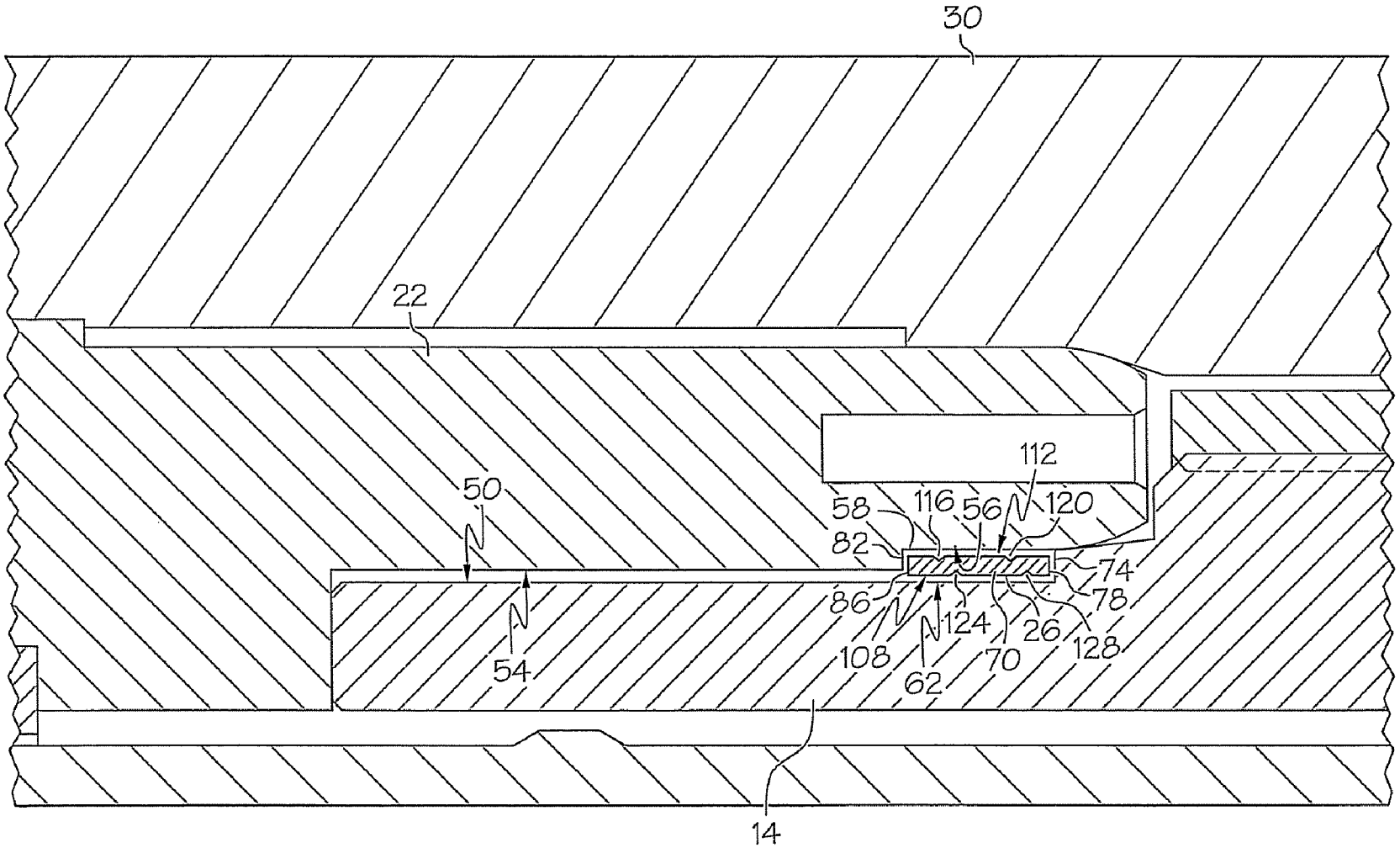
FIG. 2 depicts a magnified cross sectional view of the metal-to-metal seal of the valve of FIG. 1 shown in a non-energized position.
Figure 3:
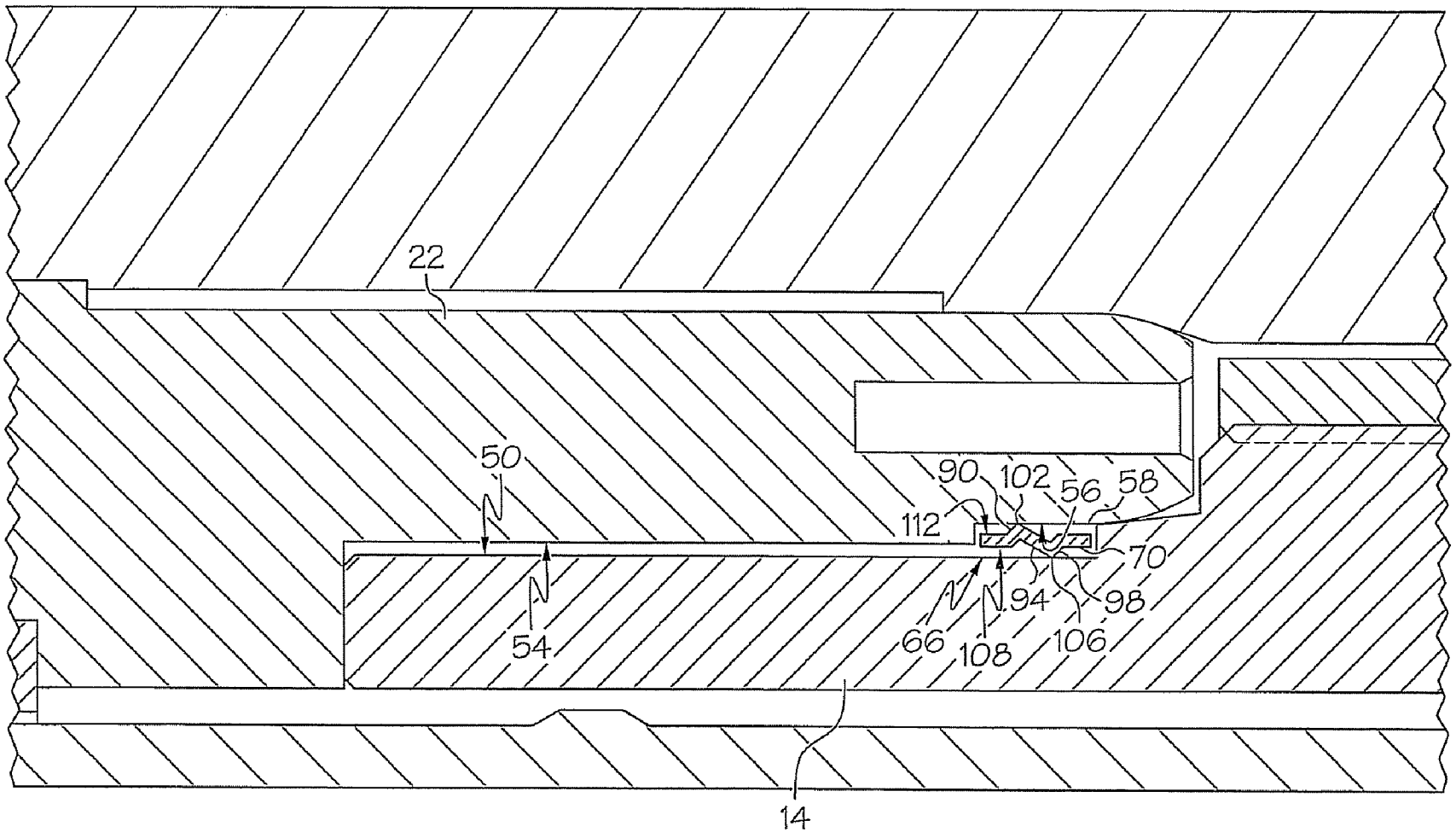
FIG. 3 depicts a magnified cross sectional view of the metal-to-metal seal of the valve of FIG. 1 shown in an energized position.

Referring to FIGS. 2 and 3, the metal-to-metal seal 26 is shown in a non-energized position 62 (FIG. 2) and in an energized position 66 (FIG. 3). In the non-energized position 62 the metal-to-metal seal 26 is slidably engagable with the outside surface 50 and the inside surface 54 and is not sealably engaged with either. In the energized position 66, however, the metal-to-metal seal 26 is sealably engaged with both the outside surface 50 and the inside surface 54 simultaneously.

The metal-to-metal seal 26 is formed from a tubular member 70. Axial compression of the tubular member 70 in this embodiment is due to the relative motion between the flapper seat 14 and the spring housing 22. A first shoulder 74 on the flapper seat 14 abuts a first axial end 78 of the tubular member 70 and a second shoulder 82 on the spring housing 22 abuts a second axial end 86 of the tubular member 70. Movement of the spring housing 22 towards the flapper seat 14 causes the first shoulder 74 to move toward the second shoulder 82 causing an axial compression of the tubular member 70 in the process. This axial compression causes the tubular member 70 to reposition from the non-energized position 62 to the energized position 66.

The tubular member 70 in the energized position 66 includes three frustoconical portions. A first frustoconical portion 90 and a second frustoconical portion 94 increases the radial dimension of the tubular member 70 to a greater radial dimension than the tubular member 70 has when in the non-energized position 62. Similarly, the second frustoconical portion 94 and a third frustoconical portion 98 decreases the radial dimension of the tubular member 70 to a smaller radial dimension than the tubular member 70 has when in the non-energized position 62. As such, in the energized position 66 the tubular member 70 has a maximum radial dimension 102 that is sealably engaged with the inside sealing surface 56. A sealing force between the maximum radial dimension 102 and the inside sealing surface 56 is due to the energizing force of the tubular member 70 being in the energized position 66. This energizing force is due to the fact that the portion of the tubular member 70, with the maximum radial dimension 102, has an even greater radial dimension (not shown) when not constrained by contact with the radial dimension of the inside sealing surface 56. Similarly, in the energized position 66 the tubular member 70 has a minimum radial dimension 106 that is sealably engaged with the outside surface 50. A sealing force between the minimum radial dimension 106 and the outside surface 50 is due to the energizing force of the tubular member 70 being in the energized position 66. This energizing force is due to the fact that the portion of the tubular member 70, with the minimum radial dimension 106, has an even smaller radial dimension (not shown) when not constrained by contact with the radial dimension of the outside surface 50.

The metal of the tubular member 70 has elasticity such that the metal-to-metal seal 26 is flexible enough to allow for minor movements of the flapper seat 14 relative to the spring housing 22 without resulting in leakage therebetween. Additionally, the metal of the tubular member 70 can be highly resistant to degradation with long term exposure to the high temperatures and high pressures commonly found in downhole environments. The metal can also be highly resistant to corrosion and caustic fluids that may be experienced downhole as well. As such the metal-to-metal seal 26 can have a high level of reliability and durability in very challenging applications.

Repositionability of the metal-to-metal seal 26 between the non-energized position 62 and the energized position 66 is effected by and is enabled by the construction thereof. The metal-to-metal seal 26 is formed from the tubular member 70 that has four lines of weakness, specifically located both axially of the tubular member 70 and with respect to an inside surface 108 and an outside surface 112 of the tubular member 70. In one embodiment, a first line of weakness 116 and a second line of weakness 120 are defined in this embodiment by diametrical grooves formed in the outside surface 78 of the tubular member 70. A third line of weakness 124 and a fourth line of weakness 128 is defined in this embodiment by a diametrical groove formed in the inside surface 108 of the tubular member 70. The four lines of weakness 116, 120, 124 and 128 each encourage local deformation of the tubular member 70 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The four lines of weakness 116, 120, 124 and 128 together encourage deformation of the tubular member 70 in a manner that creates a feature such as the energized position 66. The feature is created, then, upon the application of an axially directed mechanical compression of the tubular member 70 such that the energized position 66 is formed as the tubular member 70 is compressed to a shorter overall length.

It should be noted that in alternate embodiments the tubular member 70 could be axially compressed prior to installation between the flapper seat 14 and the spring housing 22. In such an instance the maximum radial dimension 102 is not constrained by the inside dimension of the inside sealing surface 56 until it is relocated to within the recess 58. Similarly, the minimum radial dimension 106 is not constrained by the outside dimension of the outside surface 50 until it is relocated to radially surround the outside surface 50. The metal-to-metal seal 26 of such an embodiment is in the non-energized position 62 when the metal-to-metal seal 26 is not constrained and the metal-to-metal seal 26 is in the energized position when the metal-to-metal seal 26 is relocated to the location wherein it is constrained.

In other embodiments a metal-to-metal seal may not require an axial compression to form a tubular member with maximum radial dimension 102 greater than the inner sealing surface 56 and the minimum radial dimension 106 that is smaller than the outer surface 50. For example, the metal-to-metal seal could be machined to a final shape that includes the maximum radial dimension 102, the minimum radial dimension 106 and one or more lines of weakness directly. The lines of weakness can be positioned to control distribution of stress within the metal-to-metal seal when it is constrained. The foregoing metal-to-metal seal would be non-energized until it was located within the constrained dimensions of the inside surface 56 and the outside surface 50 at which point the metal-to-metal seal would be in the energized position. Compression fit of the metal-to-metal seal between the inside surface 56 and the outside surface 50 can be such that the internal stresses within the metal-to-metal seal is maintained within an elastic range of the metal. Being within the elastic range of the metal material of the metal-to-metal seal allows the elasticity of the metal-to-metal seal to maintain the radial loads desired for the sealing of the metal-to-metal seal with the inside surface 56 and the outside surface 50 during the life of the intended application.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole valve, comprising:

a flapper seat;

a flapper sealable against the flapper seat;

a spring housing in axial alignment with the flapper seat; and a metal-to-metal seal disposed between the flapper seat and the spring housing and sealable to the flapper seat and the spring housing when in an energized position, the metal-to-metal seal being energizable in response to longitudinal compression of between the flapper seat and the spring housing, the metal-to-metal seal being energizable in response to axial compression between the flapper seat and the spring housing.

2. The downhole valve of claim 1, wherein the flapper is hingedly attached to the flapper seat.

3. The downhole valve of claim 1, wherein the flapper is sealable against an axial end of the flapper seat.

4. The downhole valve of claim 1, wherein the metal-to-metal seal is a tubular member.

5. The downhole valve of claim 1, wherein the metal-to-metal seal has a plurality of lines of weakness with at least one line of weakness on an outside surface thereof and at least one line of weakness on an inside surface thereof.

6. The downhole valve of claim 5, wherein the plurality of lines of weakness controls the internal stresses of the metal-to-metal seal.

7. The downhole valve of claim 5, wherein the plurality of lines of weakness comprise circumferential grooves.

8. The downhole valve of claim 1, wherein the metal-to-metal seal has a maximum radial dimension constrained when in the energized position.

9. The downhole valve of claim 1, wherein the metal-to-metal seal has a minimum radial dimension constrained when in the energized position.

10. The downhole valve of claim 1, wherein the metal-to-metal seal is configured to deform radially in response to axial compression thereof.

11. The downhole valve of claim 1, wherein the metal-to-metal seal is axially compressible between a surface on the flapper seat and a surface on the spring housing.

12. The downhole valve of claim 1, wherein the metal-to-metal seal is energizable in response to being compressed radially.

13. The downhole valve of claim 12, wherein the metal-to-metal seal is radially compressible between a surface on the flapper seat and a surface on the spring housing.

14. The downhole valve of claim 1, wherein the metal-to-metal seal sealably engages an outside surface of the flapper seat and sealably engages an inside surface of the spring housing.

15. A method of making a valve, comprising:

positioning a non-energized tubular member radially between a flapper seat and a spring housing, the tubular member having at least one line of weakness on an outside surface thereof and at least one line of weakness on an inside surface thereof;

energizing the tubular member with the flapper seat and the spring housing;

deforming a first portion of the tubular member radially outwardly to sealably engage one of the flapper seat and the spring housing; and deforming a second portion of the tubular member radially inwardly to sealably engage the other of the flapper seat and the spring housing that is not sealably engaged with the first portion.

16. The method of making the valve of claim 15, further comprising machining circumferential grooves into the tubular member to create the lines of weakness.

17. The method of making the valve of claim 15, further comprising positioning the tubular member, the flapper seat and the spring housing within a flapper housing.

18. The method of making the valve of claim 15, further comprising hingedly attaching a flapper to sealably engage with the flapper seat.

19. A method of sealing valve components, comprising:

energizing a tubular metal-to-metal seal with longitudinal compression between the flapper seat and the spring housing between a flapper seat and a spring housing to thereby sealingly engage the metal-to-metal seal with the flapper seat and the spring housing, the energizing further comprising:

radially compressing the metal-to-metal seal in an annular opening between the spring housing and the flapper seat.

20. The method of sealing valve components of claim 19, further comprising:

constraining a first portion of the metal-to-metal seal radially outwardly with a surface of the flapper seat: and constraining a second portion of the metal-to-metal seal radially inwardly with the spring housing.

* * * * *